US009651335B2

(12) United States Patent
DenBleyker

(10) Patent No.: US 9,651,335 B2
(45) Date of Patent: May 16, 2017

(54) NO-GUN-CONTACT HAND-GUN SHOULDER-SUPPORTED SHOOTING PLATFORM

(71) Applicant: GoTo Skelton Stocks, LLC, Hamilton, MI (US)

(72) Inventor: Thomas L. DenBleyker, Hamilton, MI (US)

(73) Assignee: GoTo Skeleton Stocks, LLC, Hamilton, MI (US)

( * ) Notice: Subject to any disclaimer, the term of this patent is extended or adjusted under 35 U.S.C. 154(b) by 0 days.

(21) Appl. No.: 14/739,179

(22) Filed: Jun. 15, 2015

(65) Prior Publication Data

US 2015/0276344 A1 Oct. 1, 2015

Related U.S. Application Data

(63) Continuation-in-part of application No. 14/460,486, filed on Aug. 15, 2014, now Pat. No. 9,188,406.

(60) Provisional application No. 61/875,188, filed on Sep. 9, 2013.

(51) Int. Cl.
*F41C 23/12* (2006.01)
*F41C 23/20* (2006.01)

(52) U.S. Cl.
CPC ..... *F41C 23/12* (2013.01); *F41C 23/20* (2013.01)

(58) Field of Classification Search
CPC ..... F41C 23/00; F41C 23/10; F41C 23/12; F41C 23/20
USPC ..... 42/71.01, 71.02, 72, 73, 74
See application file for complete search history.

(56) References Cited

U.S. PATENT DOCUMENTS

| | | | | |
|---|---|---|---|---|
| 28,433 A | | 5/1860 | Alsop | |
| 517,555 A | | 4/1894 | Reed | |
| 570,145 A | | 10/1896 | Pittavino | |
| 815,609 A | | 3/1906 | Martin | |
| 914,675 A | | 3/1909 | Renfors | |
| 1,016,695 A | | 2/1912 | Kimmel | |
| 1,477,445 A | | 12/1923 | Petritsch | |
| 1,557,865 A | | 10/1925 | Neel et al. | |
| 1,877,016 A | | 9/1932 | Muson | |
| 3,553,878 A | * | 1/1971 | Canon | F41A 23/02 42/72 |
| 3,609,902 A | | 10/1971 | Casull | |
| 3,740,886 A | * | 6/1973 | Canon | F41A 23/02 42/72 |
| 3,798,818 A | | 3/1974 | Casull | |
| D231,828 S | * | 6/1974 | Canon | F41A 23/02 42/71.01 |
| 4,271,623 A | | 6/1981 | Beretta | |
| 4,989,358 A | | 2/1991 | Aronson et al. | |

(Continued)

FOREIGN PATENT DOCUMENTS

DE GB 102941 A * 11/1917 ..... G09B 11/02

*Primary Examiner* — Jonathan C Weber
(74) *Attorney, Agent, or Firm* — Price Heneveld LLP

(57) ABSTRACT

A handgun shoulder support platform includes a shoulder support stably supporting a handgun to a shooter's shoulder when shooting the handgun, thus providing greatly improved shot accuracy. A hand-engaging bracket ("perch") on the front section matably engages and supports a shooter's hand while the shooter is grasping the grip of the handgun, but without any direct contact between the bracket and the hand gun. The bracket is L-shaped to support a backside and bottom of the shooter's hand.

5 Claims, 8 Drawing Sheets

(56) References Cited

U.S. PATENT DOCUMENTS

| | | | | |
|---|---|---|---|---|
| 5,056,253 | A | 10/1991 | Willumsen | |
| 5,092,070 | A | 3/1992 | Perkins | |
| 5,528,846 | A | 6/1996 | Baggett | |
| D411,280 | S | 6/1999 | Van Ek et al. | |
| 5,924,233 | A | 7/1999 | Strobel | |
| 6,267,335 | B1 | 7/2001 | Barrett | |
| 6,678,986 | B2 * | 1/2004 | Roush | A41D 19/0157 2/159 |
| 8,205,374 | B2 | 6/2012 | Lamm | |
| 8,438,771 | B1 | 5/2013 | Boone | |
| 2002/0007579 | A1 | 1/2002 | Bubits | |
| 2005/0262753 | A1 | 12/2005 | Lahti | |
| 2013/0167424 | A1 | 7/2013 | Nail et al. | |
| 2014/0053447 | A1 | 2/2014 | Singh | |

* cited by examiner

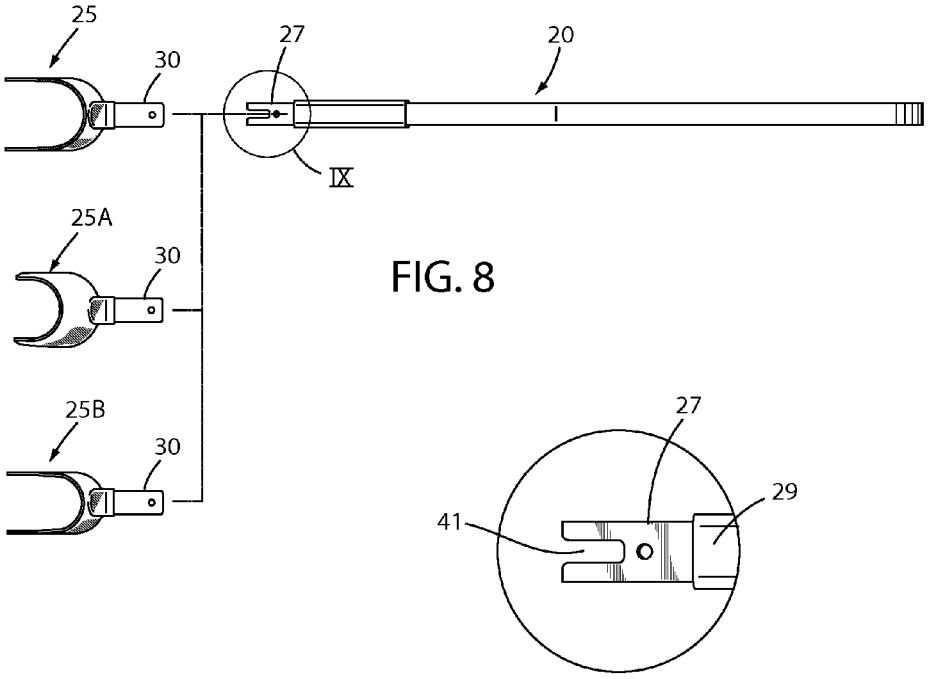
FIG. 8
FIG. 9
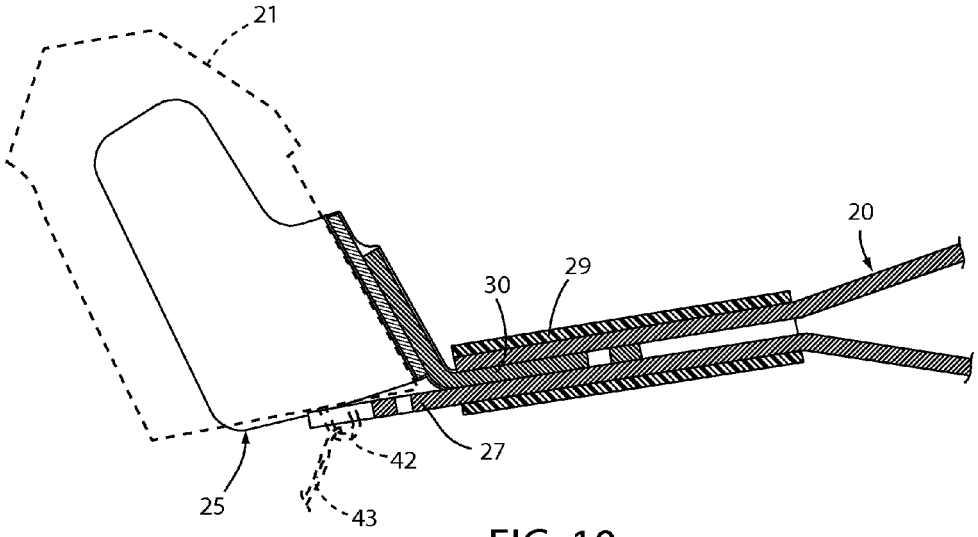
FIG. 10

NO-GUN-CONTACT HAND-GUN SHOULDER-SUPPORTED SHOOTING PLATFORM

CROSS-REFERENCED TO RELATED APPLCIATIONS

This is a continuation-in-part application claiming benefit under 35 USC §119(e) of non-provisional application Ser. No. 14/460,486, filed Aug. 15, 2014, entitled HAND GUN SHOULDER-SUPPORTED SHOOTING PLATFORM, now U.S. Pat. No. 9,188,406 which claims benefit of provisional application Ser. No. 61/875,188 filed Sep. 9, 2013, entitled HAND GUN SHOULDER-SUPPORT, the entire contents of both of which are incorporated herein in its entirety.

BACKGROUND OF THE INVENTION

The present invention relates to a handgun shoulder-supported shooting platform, and more particularly relates to a shoulder-supported platform that stabilizes a handgun for greatly improved shooting accuracy but that does so without fixed attachment of the handgun to the shoulder support.

It is known to fixedly attach stocks and extension devices to handguns so that the assembled units provide improved shooting accuracy approaching that of a long gun or rifle. However, most such stocks and extension devices include multiple components and are more costly and expensive than desired. Also, most such stocks and extension devices are uniquely customized to be fastened to a particular handgun grip, resulting in high inventory cost and low volume production runs. Also, most require modification of the handgun grip so that the devices can be fixed to the handgun grip, which many gun owners are hesitant to do.

Existing laws regulate products where a shoulder stock is fixed to a short barrel gun for improved shooting accuracy. The ATF agency interprets these laws broadly, and requires ATF approval before any such product can be publically sold. Recently, the ATF has suggested that the existing laws can potentially be interpreted to cover a shoulder shooting platform where the shooting platform is only "frictionally" held to the hand gun. An improvement is desired in shoulder-supported shooting platforms that do not require ATF approval, but that still provides greatly improved shooting accuracy, while maintaining low cost and simplicity of manufacture.

SUMMARY OF THE PRESENT INVENTION

In one aspect of the present invention, a handgun shoulder-supported platform is provided for stably supporting a handgun to a shooter's shoulder when shooting the handgun. The platform includes a shoulder support (also called a "stock") with a rear section shaped to engage a shooter's shoulder and a hand-engaging bracket (also called a "perch") shaped to matably support a shooter's hand without touching the handgun while the shooter's hand holds the handgun.

In another aspect of the present invention, a method of supporting a handgun to a shooter's shoulder for improved accuracy when shooting the handgun, comprises steps of providing a support with a rear section shaped to engage a shooter's shoulder and a front section with a bracket shaped to stably receive and support a shooter's hand while grasping a grip of the handgun, with the bracket being configured to not have any contact with the handgun; and supporting the shooter's hand on the bracket while engaging the shooter's shoulder with the support.

These and other aspects, objects, and features of the present invention will be understood and appreciated by those skilled in the art upon studying the following specification, claims, and appended drawings.

BRIEF DESCRIPTION OF DRAWINGS

FIG. 8 is a top view of FIG. 4.

FIG. 9 is an enlarged view of the circled area (i.e. the bracket-engaging tab on the "perch-end" of the shoulder-to-gun support) in FIG. 8.

FIG. 10 is a cross section taken longitudinally thru and showing the bracket connection to the support in FIG. 3.

DETAILED DESCRIPTION OF PREFERRED EMBODIMENT

Figure 1:
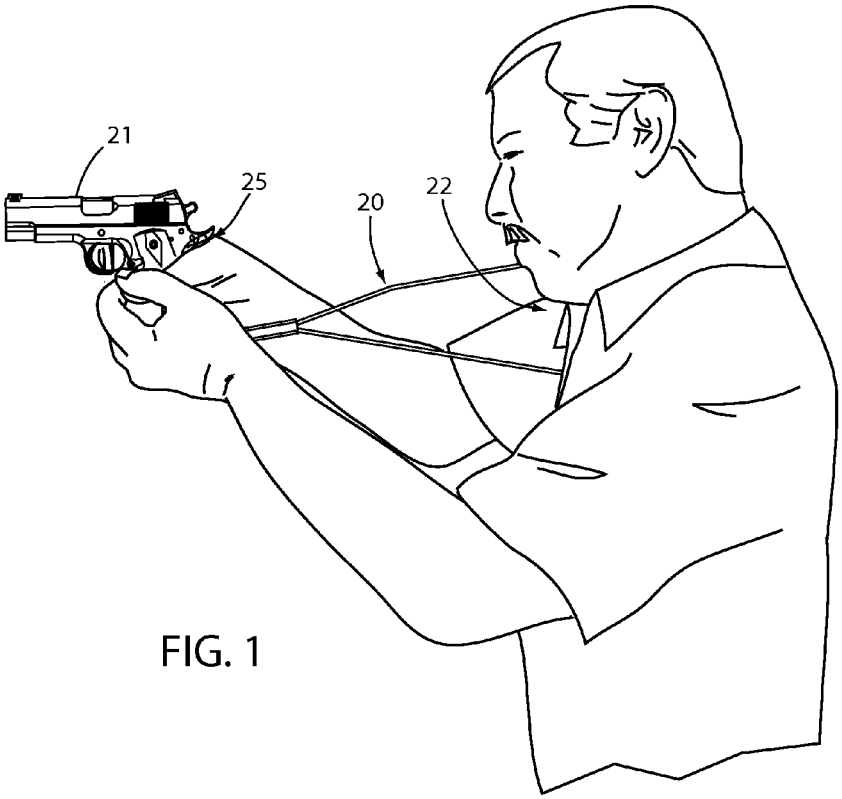
FIGS. 1-2 are perspective views of a handgun shoulder-supported platform, FIG. 1 showing a handgun supported by the present platform against a shooter's shoulder, FIG. 2 showing only the shoulder-supported platform and handgun (without the shooter).

The present apparatus comprises a shoulder-supported handgun shooting platform made of a shoulder support 20 and a gun-specific perch 25. The gun-stock-simulating shoulder-to-gun support 20 (FIG. 1, also called a "stock" herein) stably supports a handgun 21 on a shooter's shoulder 22 for accurate shooting, even without fixed attachment of the handgun to the perch 25. The resulting handgun-stabilized arrangement provides greatly improved shot accuracy approaching that of a long gun. The illustrated support 20 is made of a single elongated strip of metal with a rear section 23 (FIG. 2) shaped to stably engage the shooter's shoulder 22, and a front section 24 (FIGS. 2-4) shaped to stably removably engage the handgun-grip-engaging perch 25 (also called "bracket" herein). The bracket 25 includes a bayonet-like protruding tab 30 (FIG. 4) shaped to frictionally removably engage a socket receiver 29 (called "socket" herein) on a tail of the front section 24. The bracket 25 includes upright sidewalls, bottom wall, and rearward wall defining an upwardly-open pocket. The pocket that is vertically open but shaped to closely engage the grip of the handgun 21 so that, when firmly clasp by a shooter's hand, the handgun's grip 26 is stably supported inside the pocket of bracket 25 and becomes "one" with the support 20. Thus, the handgun 21 does not need to be secured by fasteners to fix the handgun to the platform. Notably, multiple brackets ("perches") can be provided for receiving differently shaped handgun grips (see FIG. 4, thus keeping costs down and reducing the need for a large inventory of customized gun-specific shooting platforms.

Figure 6:
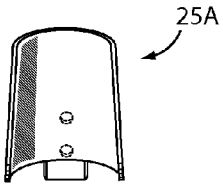
Figure 7:
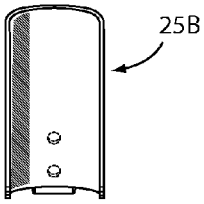
Figure 11:
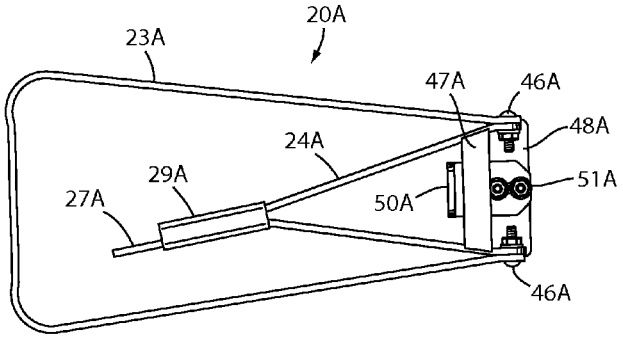
FIGS. 11-13 are side views of a modified shoulder-to-gun support, and showing the support foldable between a collapsed position (FIG. 11), an unlocked open position (FIG. 12), and a locked open position (FIG. 13).
Figure 12:
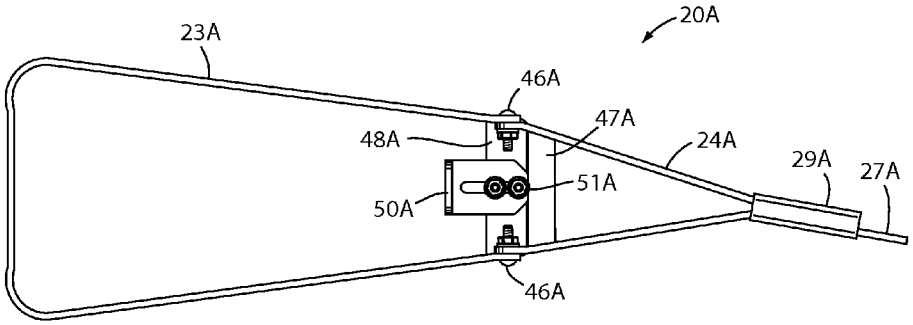

It is contemplated that the support 20 can be made of different metals and be made into different shapes. The illustrated support 20 is primarily made of a single strip of metal, such as an aluminum strip that is 1/8 inch×1/2 inch in cross section. The support 20 is about 16 inches long, with its rear section 23 being concavely shaped to fit comfortably and stably against the shooter's shoulder. The front section 24 (FIGS. 6-7) includes a horizontal lower tine 27 (and potentially an angled upper tine) secured to a socket 29. It is contemplated that the tine 27 can partially form the socket if desired, or only be an attachment site for a separate tube. The illustrated socket 29 is designed to frictionally receive the rearward bayonet-like tab 30 of the bracket 25. However, it is contemplated that the socket 29 can be formed by various means, such as by using a metal tube or strip of material. It is contemplated that a scope of the present invention also includes other ways to attach the bracket 25 to the support 20, such as by screws or other mechanical fasteners. Also, the scope of the present invention includes various shoulder-engaging shapes, cushioned and not cushioned.

Figure 5:
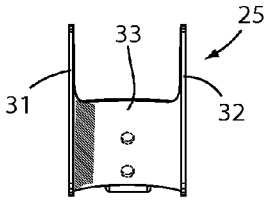
FIGS. 5-7 are end views of the three brackets in FIG. 4.

As noted, the illustrated bracket 25 includes walls 31-33 (FIG. 5) forming an upwardly-open C-shape or cup-shape (see FIG. 8) and includes the tab 30 for bayonet-like mating frictional attachment into the socket 29. A thinness of the walls 31-33 of the bracket 25 and a shape of the support 20 allow a shooter to clasp the grip 25 and the front section 24 as a unit, which greatly improved shooting accuracy, approaching that of a long gun. Further, when a shooter grips the handgun's grip and bracket 25 and draws the shooting platform against his/her shoulder, the resulting forces tend to cause the bracket 25 to more-securely engage the support 20, thus resulting in even greater stability. In the illustrated arrangement, the bracket 25 is welded or soldered to the tab 30, but it is contemplated that the bracket 25 could be attached by other means, such as by a pair of screws, rivets, brazing, solder, or even adhesives. Sides of the bracket 25 are shaped to closely support sides of the grip 25 when the grip and bracket are clasped by a shooter's hands, thus causing the grip and bracket to become a unit when clasp by the shooter's hands. (See FIG. 1.) My testing suggests that the present support 20 can improve shooting accuracy by 90%. Also, my testing suggests that while most shooters can shoot with a reasonable accuracy at 30 yards, the present support 20 can provide them with good shooting accuracy up to 60 yards or more, such as 80-100 yards.

Figure 2:
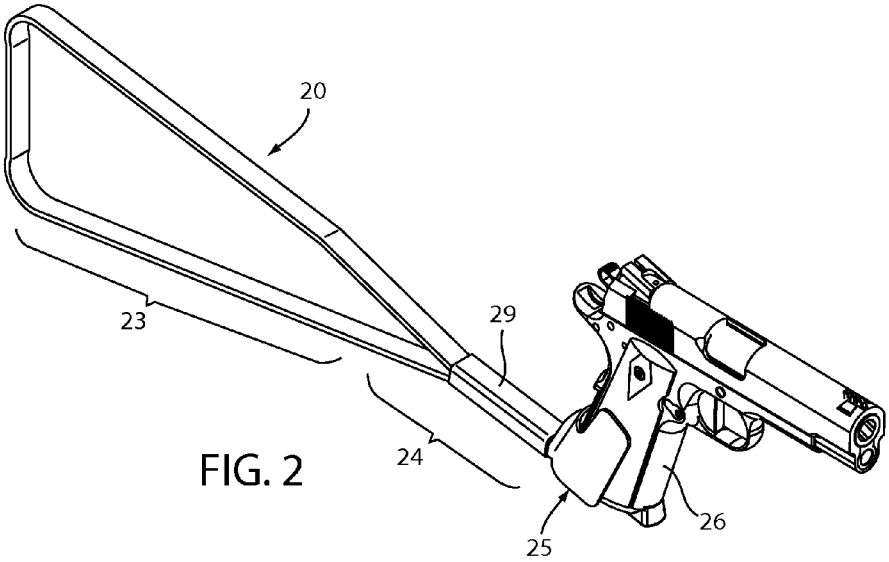
Figure 3:
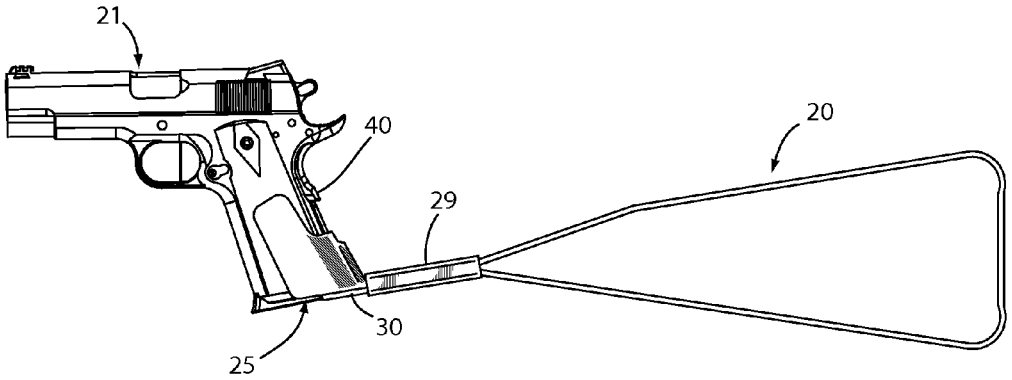
FIG. 3 is a side view of FIG. 2.
Figure 4:
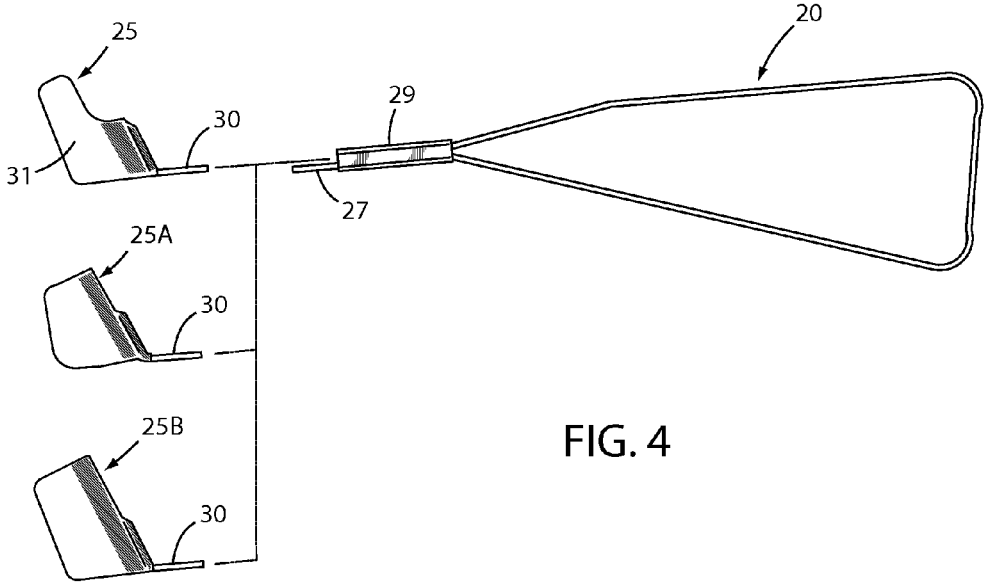
FIG. 4 is a side view of the handgun shoulder-supported platform in FIG. 3, the platform including a shoulder-to-gun support (also called a "stock") and three removable handgun-grip-engaging brackets (also called "perches")

FIGS. 1-2 are side views of a handgun supported by the present innovative handgun shoulder support against a shooter's shoulder, FIG. 1 showing the shooter close to taking a shot and generally showing hand and eye positions, and showing the relationship of the handgun and support 20 to the shooter's shoulder. FIGS. 3-8 show details of three different brackets 25-25B. The bracket 25 (FIGS. 4-5, 8) includes upwardly-extended sidewalls that extend above the fore-shortened rear wall (see FIG. 3) to define an opening for non-interferingly exposing a grip-supported palm safety 40 on the handgun 21. Also, the bottom wall on the bracket 25 is fore-shortened and the tab 30 includes an open-ended slot 41 (FIG. 9) shaped to non-interferingly receive a downwardly-extending loop 42 on the handgun's grip. This allows a lanyard/cord 43 to be connected between the loop and a shooter, so that the handgun is not lost even if accidentally dropped by the shooter. The brackets 25A (FIGS. 4,6,8) and 25B (FIGS. 4,7,8) show that the walls of the brackets can be changed to accommodate different handgrip shapes.

FIGS. 11-13 and 14-16 are side views of alternative handgun shoulder supports 20A and 20B and perches 25A and 25B. Similar and identical components, features, and characteristics are identified using similar numbers but with a letter "A" or "B". This is done to reduce redundant discussion.

Figure 13:
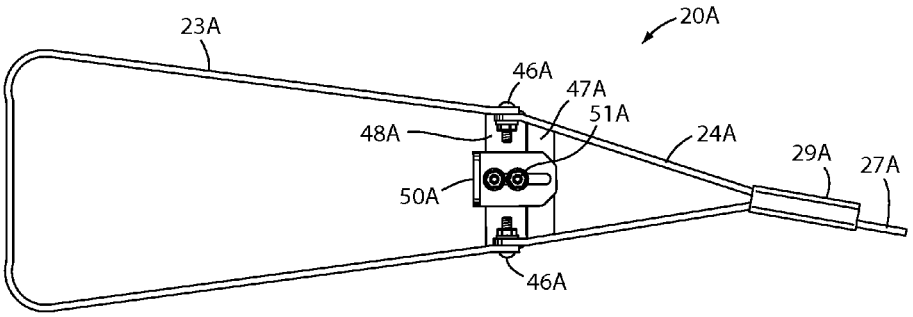

The illustrated support 20A (FIGS. 11-13) includes front and rear sections 24A and 23A made of strip metal and pivoted together at a hinge formed by top and bottom vertical bolts 46A. The support 20A also includes a tine 27A (i.e. releasable connector) and tab-receiving socket 29A. Vertical strips 47A and 48A on front and rear sections 24A and 23A maintain a shape of the sections 23A-24A so that they do not collapse and undesirably bend the area around hinge bolts 46A. The strip 48A also supports a plate-like lock 50A (illustrated as a slidable flat tab) slidably mounted on two screws 51A. The lock 50A can be moved between a retracted release position (FIGS. 11-12) allowing the sections 24A,23A to be collapsed to a folded position (FIG. 11) and or unfolded and moved to an extended unlocked position (FIG. 12) and to an extended locked position (FIG. 13). In the extended locked position, the lock 50A engages the strip 47A with sufficient surface area and strength so that the support is stable (and so that it will not accidentally fold when shooting). It is noted that the lock 50A provides enough friction to hold itself in a selected position. The friction can be provided by the sliding action, or by a detent on the interfacing surfaces of the lock 50A and strip 48A, or can include a thumb nut on one of the screws 51A.

A method related to the present apparatus includes steps of providing a shoulder-to-gun support with a rear section shaped to engage a shooter's shoulder and a front section with bracket shaped to stably receive and support a grip of the handgun when clasped by hands of the shooter but with the bracket not being fixedly attached to the grip, supporting the handgun on the shoulder-to-gun support without fixed interconnection and while resting the support on a shooter's shoulder and while simultaneously clasping the grip and bracket with hands of the shooter, and shooting the handgun during the step of supporting.

Figure 14:
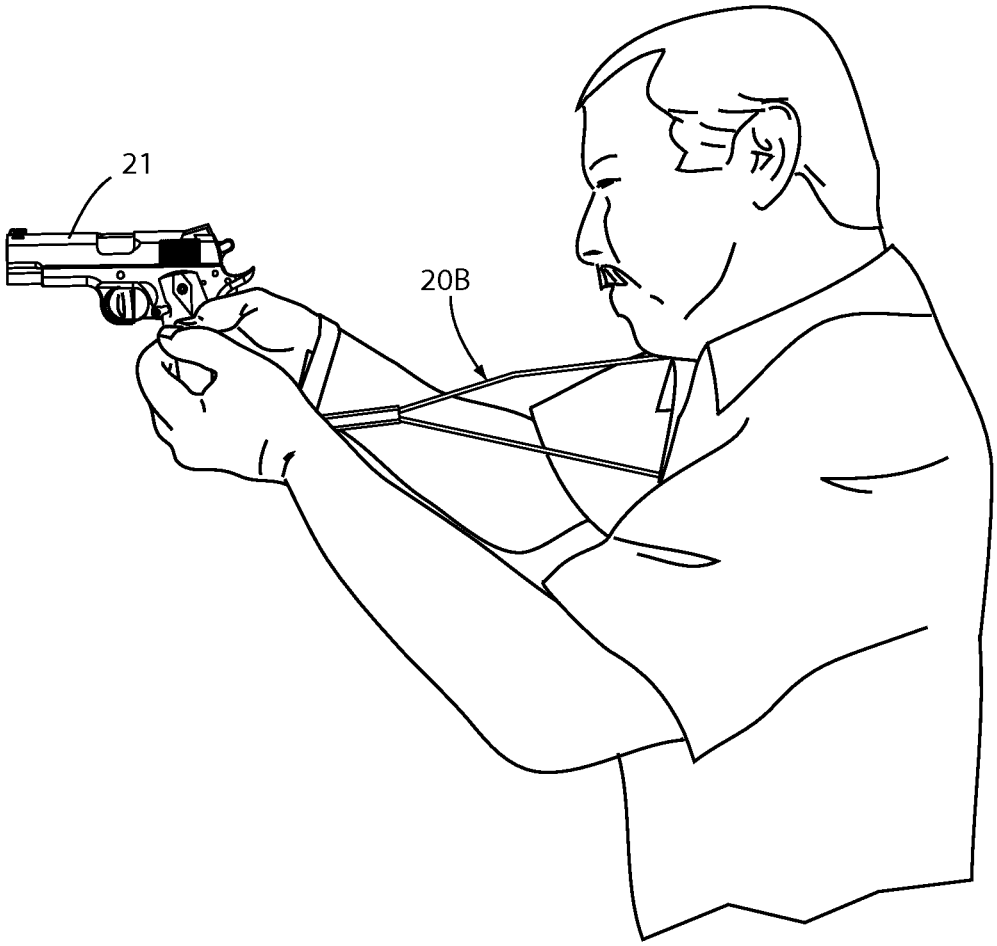
FIGS. 14, 14A, and 14B are side perspective views of a further modified shoulder-to-hand shooting platform for hand guns, with FIG. 14 showing a right-handed shooter from his left side using the shooting platform, FIG. 14A being like FIG. 14 but with the shooter's left hand/wrist removed to show the handgun's grip, and FIG. 14B showing the right-handed shooter from his right side using the shooting platform.
Figure 14A:
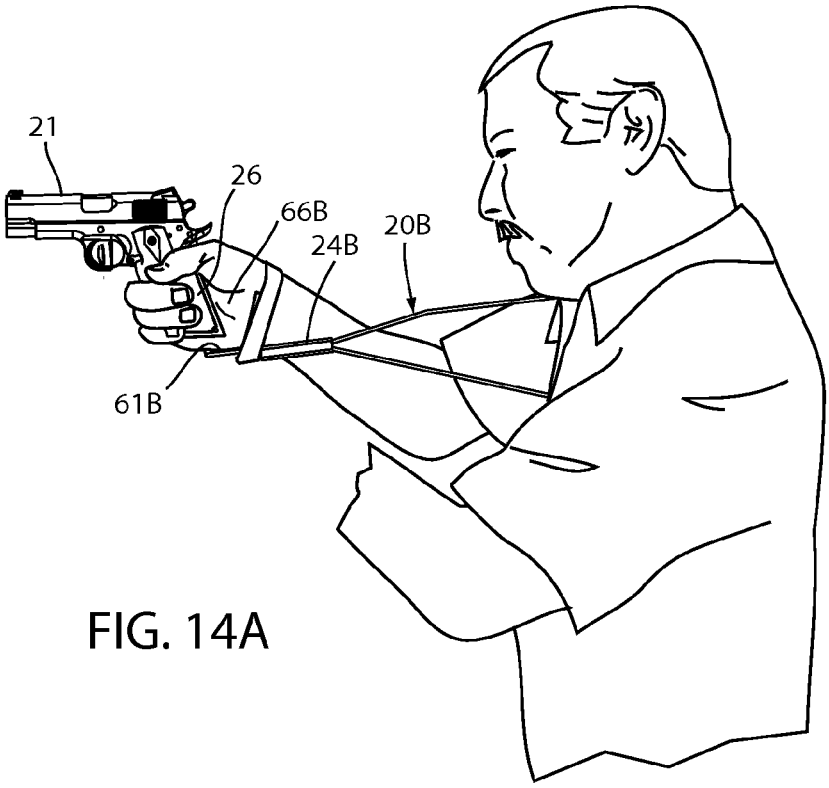
Figure 14B:
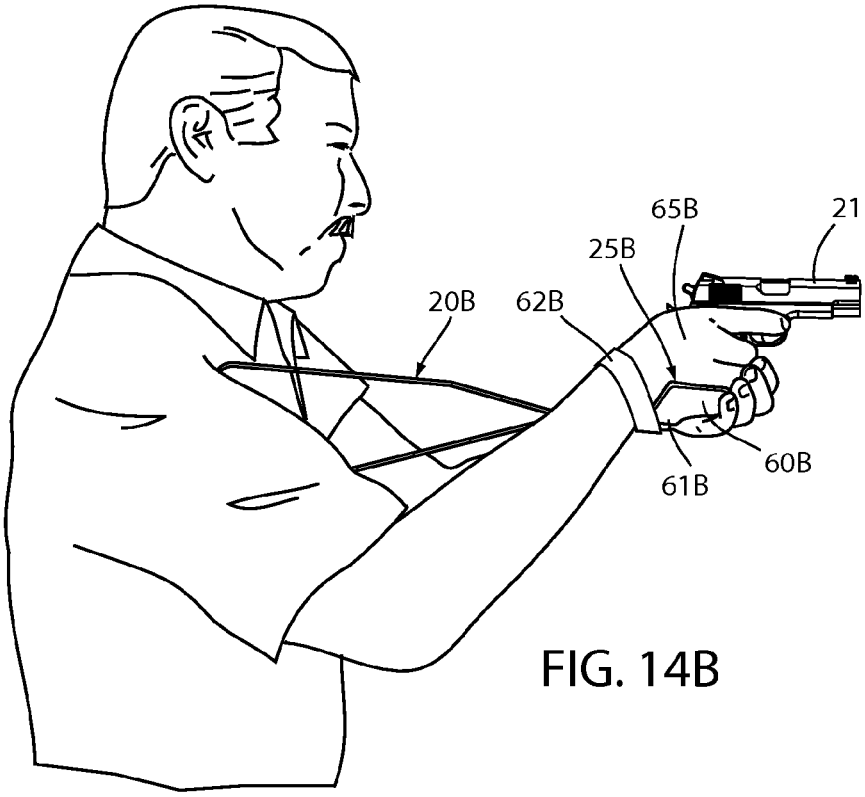
Figure 15:
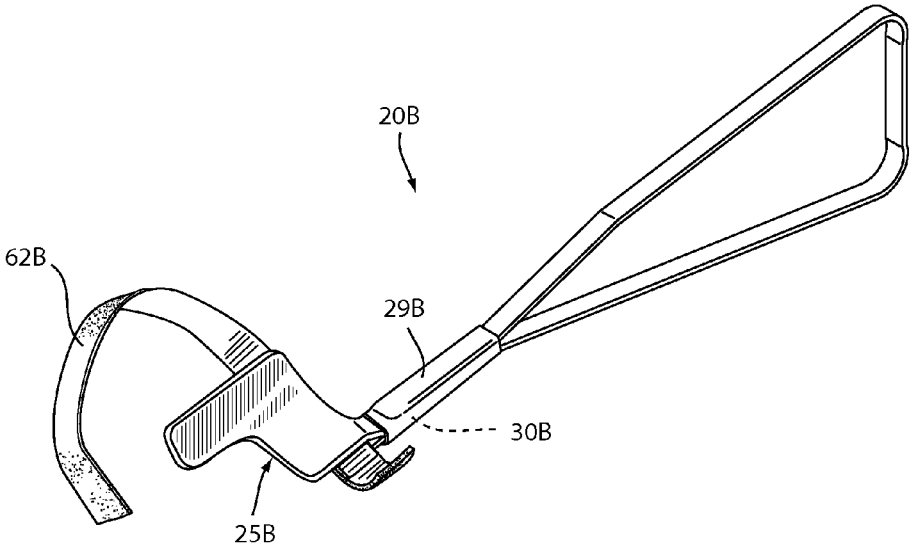
FIGS. 15-16 are perspective views showing details of the shooting platform with shoulder support and hand-supporting perch.
Figure 16:
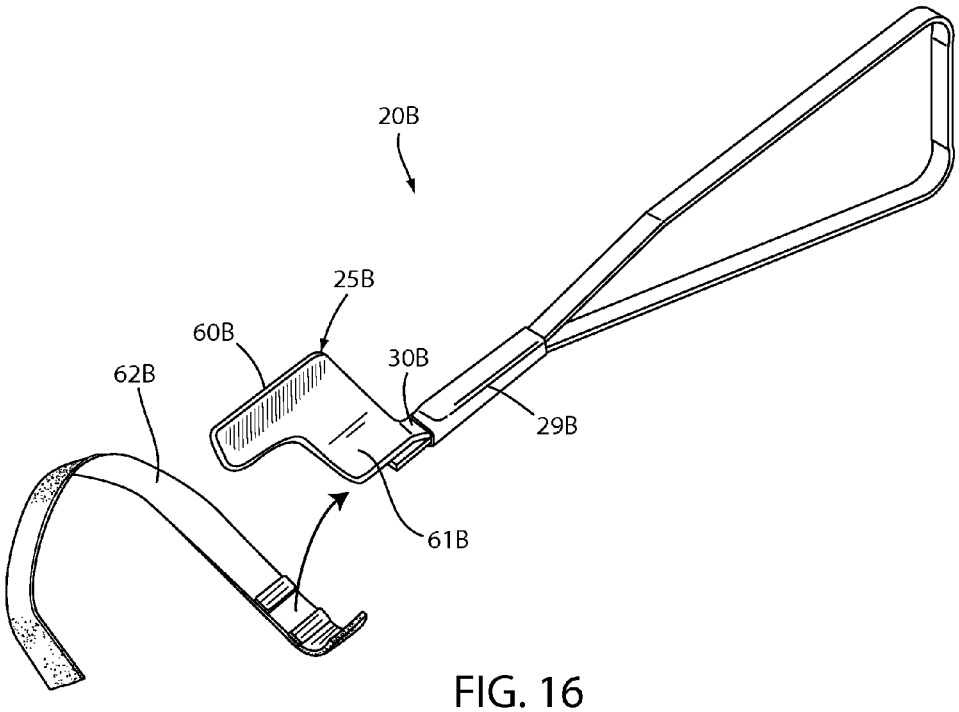
Figure 17:
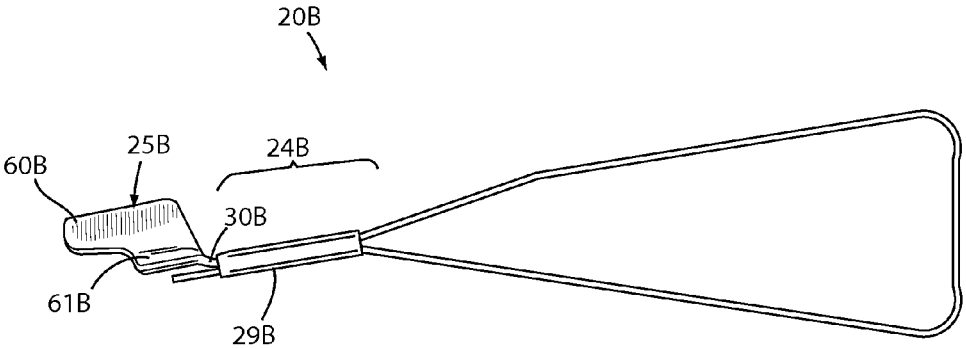
FIGS. 17-19 are (left) side, top and front views of the shooting platform of FIG. 15 (with the hook-and-loop strip removed to better show underlying components).
Figure 18:
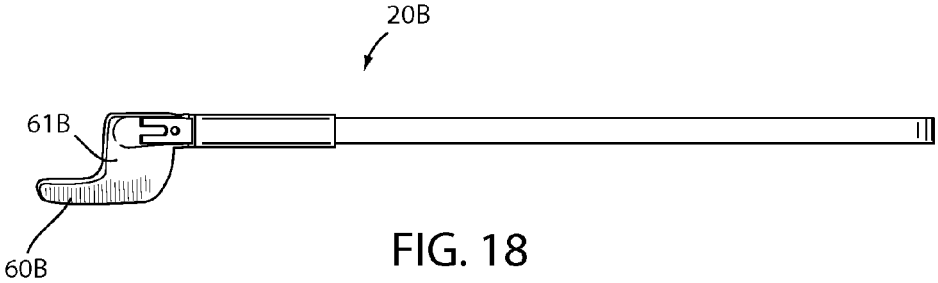
Figure 19:
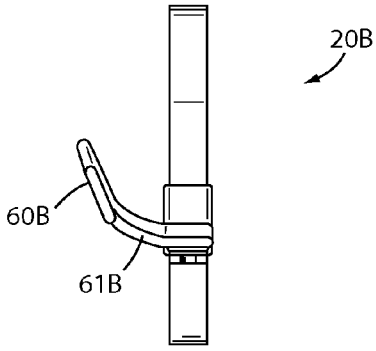

Another embodiment of the present shooting platform apparatus is shown in FIGS. 14-19, with FIGS. 14-14B showing a shooter using the modified shooting platform, and FIGS. 15-19 showing additional details of the shooting platform with shoulder support 20B and hand-supporting perch 25B.

In FIGS. 14-14B, the modified shooting platform includes a gun-stock-simulating shoulder-to-gun support 20B (FIG. 1, also called a "stock" herein) and hand-engaging perch 25B stably support a shooter's hand (and support the handgun 21 in the shooter's hand) without any contact between the perch 25B and the handgun 21. Instead, the perch 25B supports a bottom and a back-side 65B of the shooter's shooting palm/hand (in this case, the shooter's right hand), while a front/inside 66B of the shooter's (right) hand supports the handgun 21. The shooter's second hand (i.e. his left hand as illustrated) supports his first hand, including holding the perch 25B against a back side of the shooter's first hand. The support 20B extends from the perch 25B to the shooter's shoulder 22. The resulting handgun-stabilized arrangement provides greatly improved shot accuracy approaching that of a long gun, even without fixed attachment of the handgun to the perch 25. Our testing suggests that the present apparatus of FIGS. 14-19 provides a shooting accuracy that is at least as accurate as the apparatus shown in FIGS. 1-3, if not more accurate. The strip 63B of hook and loop material helps stabilize the shooter's hands by securing the shooting platform to the shooter's (right) hand and wrist, but it is contemplated that excellent shooting accuracy can be achieved even without the strip 63B.

The support 20B illustrated in FIGS. 14-19 is identical to the support 20 (FIGS. 1-10), but it is contemplated that the support 20A (FIGS. 11-13) can also be used to support the perch 25B. The illustrated support 20B includes a rear section 23B for engaging a shooter's shoulder, and a front section 24B for supporting the perch 25B. The perch 25B (also called "bracket" herein) includes a rearwardly-extending bayonet-like protruding tab 30B shaped to frictionally removably engage a socket receiver 29B (called "socket" herein) on a tail of the front section 24B. The bracket 25B includes only a single upright sidewall 60B and a bottom wall 61B, the combination of which define an "L" shape shaped to comfortably and stably engage the backside and bottom of a shooter's hand/palm, respectively. It is noted that the strip 63B of hook-and-loop material can be used to better connect the shooter's hand to the shooting platform if desired.

The triangular arrangement of the support 20B, the shooter's arms, and the shooter's chest (i.e. the region between where the shooter's body supports the support 20B and the shooter's shoulder supports his arm) is very stable, and when combined with the upright sidewall 60B, it results in very good shooting accuracy horizontally. The perch 25B also has a bottom wall that supports a bottom of the shooter's hand. This provides very good shooting accuracy in a vertical direction when aiming the handgun 21. All of this is accomplished without any contact between the perch 25B and the handgun 21, which is considered a very surprising and unexpected result.

To summarize, the supporter 20B and associated perch 25B are designed so that they never touch the handgun nor its grip. Instead, the handgun's grip is firmly and entirely held by the shooter's hand/palm. Concurrently, the supporter 20B and perch 25B solely support the shooter's hands, such that the shooter's hand and the hand gun become "one" with the support 20B and perch 25B, even though the perch doesn't touch the handgun. This avoids the need to use any mechanical fastening (i.e. no fasteners and not even a frictional connection) to fix the handgun to the shooting platform. The strip 63B of hook and loop material further "ties" the perch 25B and support 20B to the shooter, but improved shooting accuracy is possible even without the strip. It is contemplated that multiple different brackets ("perches") can be provided for receiving differently shaped hands, thus keeping costs down and reducing the need for a large inventory of customized gun-specific shooting platforms.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A shoulder-supported platform for stably supporting a shooter's gun-holding hand when shooting a handgun, comprising:

a shoulder support made of at least one elongated strip of metal of a first constant cross section defining a forwardly-extending first tab and a rear section shaped to engage a shooter's shoulder;

a hand-engaging bracket shaped to matably support a shooter's gun-holding hand without touching the handgun while the shooter's gun-holding hand holds the handgun;

the bracket consisting of an upright side wall and a bottom wall that define an L-shape when viewed in a fore-aft direction, the walls combining to define a recess that is upwardly open and laterally open so that the bracket, when positioned under and engaging a backside of the shooter's gun-holding hand, is shaped to receive the shooter's other hand to hold the bracket against the shooter's gun-holding hand; and the bracket including, a second tab having a same cross section as the first constant cross section, and one of the bracket and the shoulder support having a tube forming a socket shaped to receive the first and second tabs and hold them in an abutting juxtaposed position.

2. The platform in claim 1, wherein the support includes a front section positioned between the rear section and the bracket, and wherein the hand-engaging bracket is removably attached to the front section by the first and second tabs and mating socket that form a non-rotatable stable connection.

3. The platform in claim 2, wherein the side wall and bottom wall of the bracket supporting the bottom and backside of the shooter's gun-holding hand have a shape generally matching a bottom and backside of the shooter's first hand and have a relatively constant wall thickness.

4. The platform in claim 1, wherein the the first and second tabs and mating socket forming a frictional non-rotatable bayonet-simulating connection.

5. The platform in claim 1, wherein the shoulder support includes a rear section extending between the rear section and the bracket, and wherein the front and rear sections can be moved between an extended use position and a folded compact storage position.

* * * * *